United States Patent [19]

Wait, Jr.

[11] 4,101,090

[45] Jul. 18, 1978

[54] REEL STRUCTURE

[76] Inventor: Albert L. Wait, Jr., 406 S. Peoria, Tulsa, Okla. 74101

[21] Appl. No.: 817,562

[22] Filed: Jul. 21, 1977

[51] Int. Cl.[2] ..... B65H 75/40

[52] U.S. Cl. ..... 242/96; 244/155 A

[58] Field of Search ..... 242/96, 99, 85, 106, 242/67.1 R, 56.9; 244/153 R, 155 R, 155 A

[56] References Cited

U.S. PATENT DOCUMENTS

| | | | |
|---|---|---|---|
| 274,490 | 3/1883 | Gunn | 242/96 |
| 2,388,478 | 11/1945 | Garber | 244/155 A |
| 2,587,432 | 2/1952 | Bellah | 242/96 |
| 3,338,536 | 8/1967 | Hull | 242/96 X |

*Primary Examiner*—Edward J. McCarthy
*Attorney, Agent, or Firm*—Arthur L. Wade

[57] ABSTRACT

A reel for retrieving and discharging a line has more than one hub for storing the line. The hubs are concentrically aligned with a dividing plate captured between them and a radial slot in the plate with which the line can be transferred between the hubs as it is retrieved. Means for steadying the reel structure against the body of the operator and handles for rotating the reel are provided so the assembly may be manually operated with either hand.

6 Claims, 2 Drawing Figures

REEL STRUCTURE

BACKGROUND OF THE INVENTION

Kite flying has gained steadily in popularity. The technology of kites has included developments in the reel structure with which the kites have been adjusted in vertical height from the ground and maneuvered while air-borne.

Multiple reels have been developed, mounted on common supports to control multiple lines to kites. However, there is the problem of varying the speed of retrieving lines other than with control of the rotational speed of the reel. Reel hubs of fixed diameter have been controlled in their speed of rotation. However, the art has not provided means within the dimensions of the reel changing the speed at which lines have been retrieved.

SUMMARY OF THE INVENTION

The present invention provides a reel with multiple hubs with diameters which differ from each other. The line retrieved upon these hubs can be readily shifted from one hub to the other to change the mechanical advantage, and therefore the speed, with which the line is retrieved.

The invention includes a provision for support of the hub assembly from the body of the operator. Further, the support provides for readily changing between left and right hand manual operation of the multiple-hub reel.

Other objects and features of the invention will become apparent to those skilled in the art as the disclosure is made in the following detailed description of the drawings, the drawings, and the following claims.

DESCRIPTION OF THE PREFERRED EMBODIMENT

Figure 1:
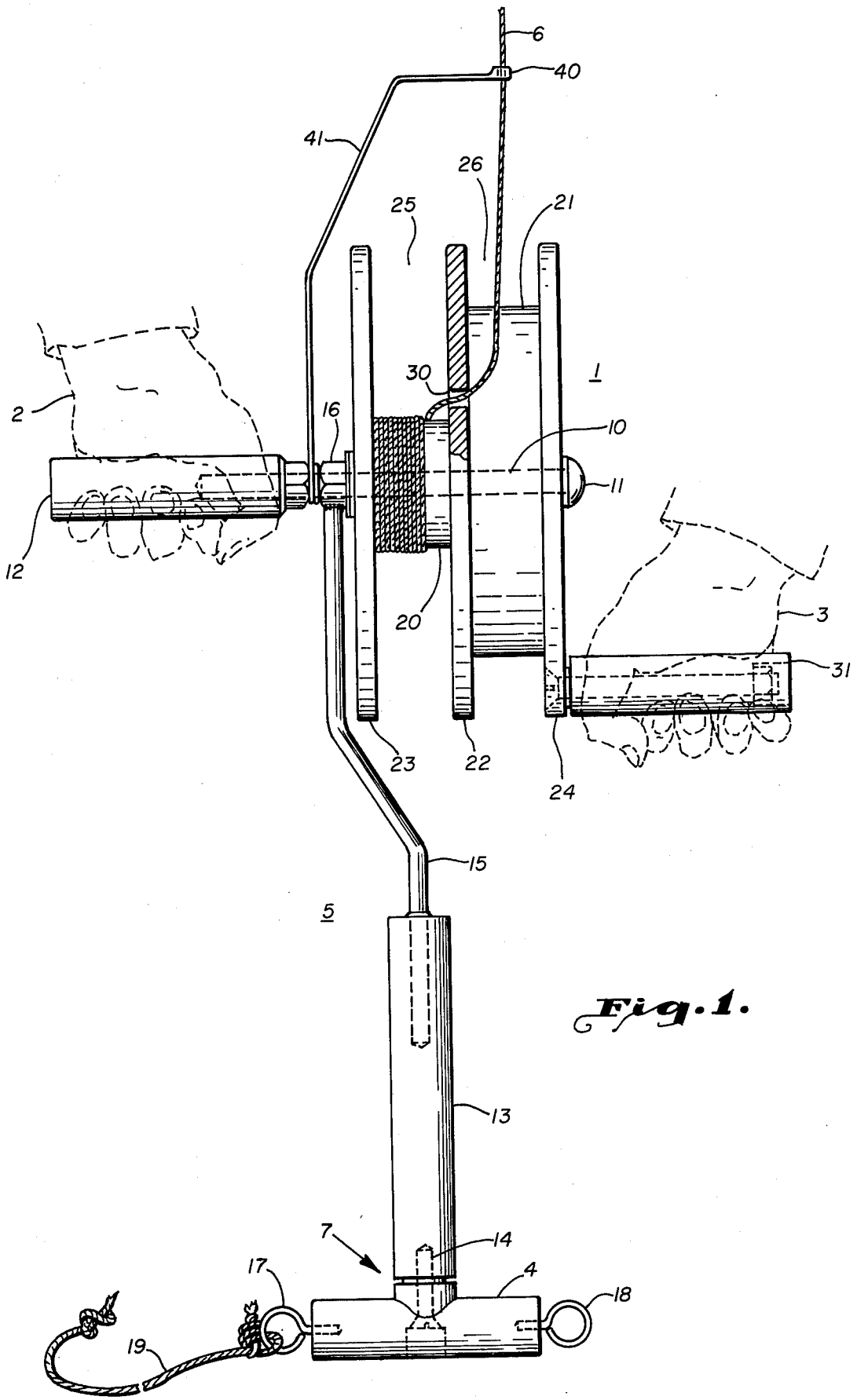
FIG. 1 is a partially sectioned elevation of a multiple-hubbed reel structure as manually operated while steadied on the body of the operator and embodying the present invention.

Referring specifically to FIG. 1, reel 1 is disclosed as grasped by the left hand 2 and right hand 3 of an operator. The reel 1 is steadied upon the mid-section of the operator with a base 4. A post 5 pivotally connects base 4 with the reel 1. Supported by base 4, the body of the operator and the hands of the operator, the reel 1 can be completely manipulated to retrieve and discharge line 6 as desired by the operator.

Figure 2:
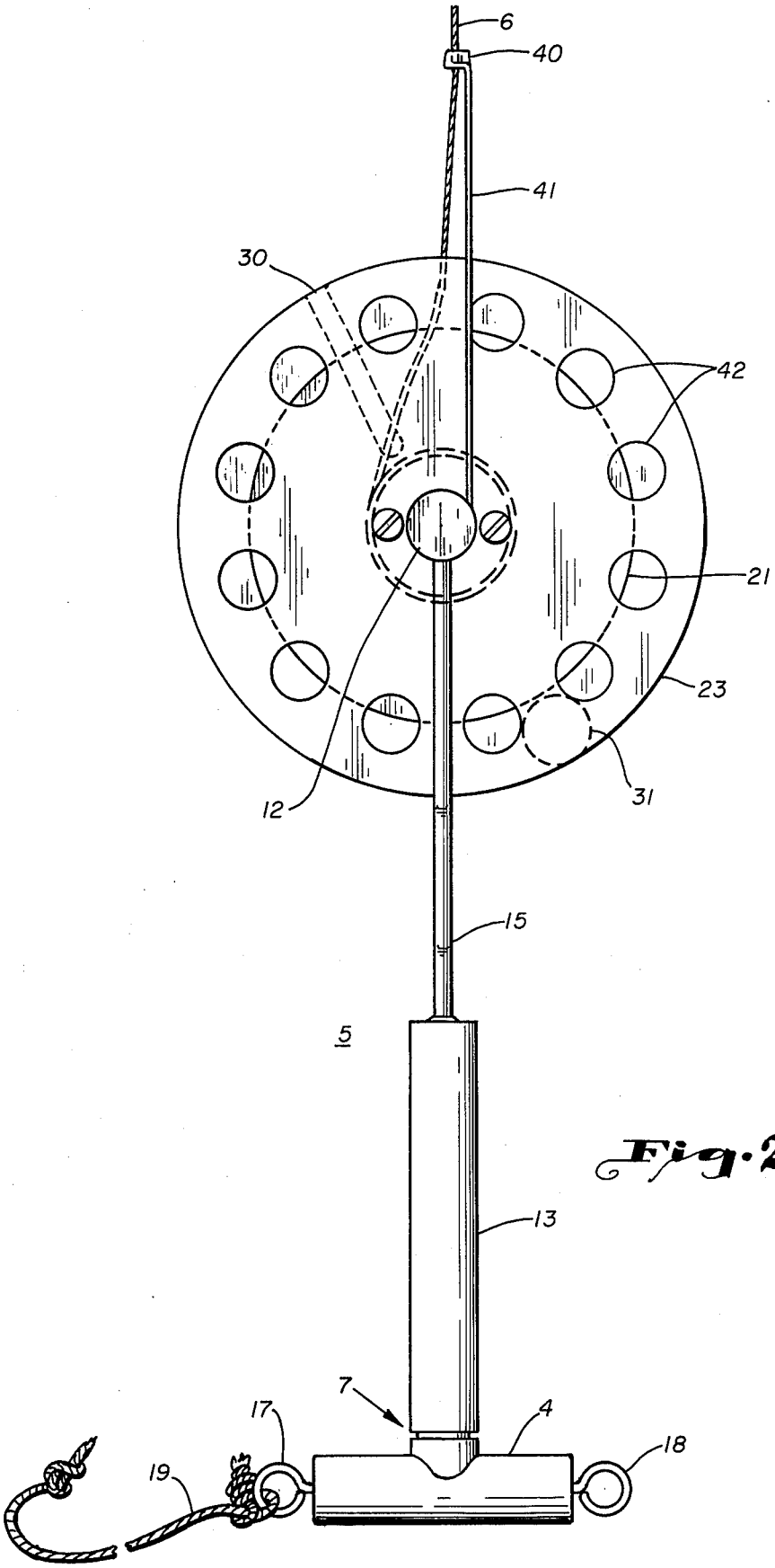
FIG. 2 is an elevation of the structure of FIG. 1 rotated 90° counterclockwise.

FIG. 1 discloses the reel being basically held in position by the left hand 2 and rotated by the right hand 3. The reel is pivoted on base 4 at pivot point 7 as desired by the operator. FIG. 2 discloses the reel in a transition position as it is pivoted. Specifically, the reel is pivoted counterclockwise 90°. When pivoted 180°, the reel will be basically held in position by the right hand 3 and rotated, while in its alternate position, with left hand 2. One reason for changing between the alternate positions is to relieve fatigue of the hand used to rotate the reel.

The reel 1 is formed about axle 10 which is disclosed as embodied, basically, in a shaft with a retaining head 11. The left end of axle-shaft 10 is extended into a handle 12 which is sized to be firmly grasped by hand 2.

Shaft-axle 10 and handle 12 can be joined in any convenient manner. Together, they form an elongated member upon which the other components of reel 1 are captured and on which the other components are rotated.

Post 5 may be formed of one or more sub-posts. Essentially, it is a structure providing fairly rigid support to the reel from base 4. In FIG. 1 post 5 is disclosed as having a portion 13 into the lower end of which is readily inserted on axial pin 14 joining the center of base 4. The portion 13, and therefore the entire post 5, pivots at 7 rather freely.

The upper portion 15 of post 5 was reduced to practice with a metallic rod. As shown in the drawing this rod supports a bushing 16 at its upper end, journalled over axle 10. This complete arrangement gives pivotal support to the shaft 10 upon base 4.

The complete assembly of reel 1 is provided the steadiness of support by the midsection of the operator. Base 4 is rested upon the midsection. Further, eye-rings 17, 18 are anchored in each end of base 4. Finally, a lanyard 19 is extended about the midsection of the operator and tied to both eye-rings. A degree of freedom is thereby provided the reel, on the end of post 5, but it is basically steadied as it is pivoted and rotated manually to wind and unwind line 6 on its hubs.

The fundamental, end function of the reel, is to retrieve and discharge line 6 as desired at the whim of the operator. Multiple hubs are rotated as line 6 is wound upon and released from the hubs. More than the two hubs disclosed can be mounted upon the axle 10, but two hubs will disclose the invention.

First hub 20 is disclosed as smaller than second hub 21. However, either hub can be disclosed as the "first" hub. The basic concept is that each hub has a finite diameter and each hub diameter is different from its companion hub, or hubs. Further, the hubs are mounted to rotate together on axle 10 with a plate 22 captured between them. The plate and capturing hubs can be said to rotate concentrically. Perhaps more precisely, the hubs have a common axis in axle 10 and rotate on that axle as a unit.

Plates 23, 24 are each mounted on the outside ends of the assembly of hubs 20, 21. These plates 23, 24 have diameters greater than the larger of the hubs. Thus, with plate 22, groove 25 and groove 26 structure is formed with which line 6 is wound upon hub 20 and/or hub 21. Grooves 25 and 26 may be described as contiguous, one on each side of plate 22. Line 6 is wound on hub 20/groove 25, as illustrated, or on hub 21/groove 26 as selected by the operator.

We have now arrived at the vital and essential concepts of the invention. Line 6 is wound upon either hub. The diameter of a specific hub enables the line to be retrieved upon the hub at a speed dependent upon the speed of rotation of the hub and the diameter of the hub. The factor of the hub diameter can be changed readily, with the invention. The line 6 can be flipped to a second hub which has a different diameter. The invention provides retaining structure on the plate for this purpose of transfer.

As disclosed, the simple structure of a radial slot 30 provides retaining structure mounted on the outer edge of plate 22. This slot 30 can be seen in both FIGS. 1 and 2 as a convenient structure with which the operator can "hook" line 6 and transfer the line from hub 20/groove 25 to hub 21/groove 26 or back again. The flexibility of this shifting line 6 from hub to hub is provided for the operator by the invention. With the invention the operator has complete control of the operation of the reel.

Handle 31 is mounted off-center upon plate 24. With handle 31, as shown in FIG. 1, hand 3 rotates reel 1, and line 6 is guided upon hub 21, as disclosed, or hooked in slot 30 and transferred to hub 20. The factor of hub diameter in speed change is thereby selected and changed by the operator with the invention.

The remaining structure is important but auxilliary to that in which the inventive concept is embodied. A guide ferrule 40 is mounted on the end of a guide post 41. Guide post 41 is extended up from axle 10. The ferrule gives a degree of stability to line 6 which is threaded through it.

Apertures 42 are provided in the plates 22, 23, 24. These holes provide ventilation to the line after it is wound upon the hubs. Should the line be retrieved wet, its drying will be helped by the circulation of air through holes 42.

The immediate use for line 6, controlled with reel 1, is to tether a kite as it is flown above the earth. However, it is certainly contemplated that the reel, embodying the invention, be used to control line for other purposes. The invention is in the structure to control the retrieving and discharge of line, not in the use of the line as it is retrieved and discharged.

Structuring definitions of the various facets of the inventive concepts in the disclosure is difficult to couch in robust language within this particular art. As novel as the concepts are, they are embodied in structure which must be described in words such as line, reel, manual control, hub, plate, retrieve and discharge. This is hardly a dramatic arsenal from which to select telling combinations that will ring with the solid advances this invention makes in the art. Therefore, if there is a lack of words with a persuasive bite to them, I have at least tried to select words and phrases which trace the periphery of the scope of the present invention with simplicity and clarity.

From the foregoing it will be seen that this invention is one well adapted to attain all of the ends and objects hereinabove set forth, together with other advantages which are obvious and which are inherent in the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A reel structure with which line is retrieved and discharged, including, an axle, a first hub with a finite diameter mounted on the axle for rotating about the axle, a second hub with the diameter different from that of the first hub and concentrically mounted on the axle for rotation with the first hub, a first plate captured between the two hubs and mounted to rotate with the hubs as a unit on the axle, second and third plates, each mounted on the outside ends of the assembly of two hubs with diameters greater than the hubs to form contiguous grooves with the first plate upon which line may be wound and unwound, retaining structure mounted at the outer edge of the first plate in a position to be actuated to engage and direct a line being wound and unwound on the first of the hubs that the line may be wound and unwound on the second of the hubs, and means for rotating the assembly of plates and hubs about the axis of the axle as the line is wound and unwound from either of the hubs.

2. The reel structure of claim 1 in which, the retaining structure of the first plate is in the form of a radial slot.

3. The reel structure of claim 1 in which, the means for rotating the assembly includes, a first handle mounted at the axle, and a second handle mounted on the plate opposite the first handle and offset from the axis of the axle.

4. The reel structure of claim 3 including, a support rod mounted by one end to the assembly at the axis of the axle and having a body-engaging structure at the other end to rest and steady the assembly while operated.

5. The reel structure of claim 4 in which, the body-engaging structure at the end of the support rod is mounted so as to provide a pivoting of the rod and the assembly at the other end of the rod.

6. The reel structure of claim 5 including, a lanyard connected to the body-engaging structure and arranged to encircle the body to stabilize the rod and assembly while rotated and pivoted for alternate manual operation of the second handle.

* * * * *